US005562036A

United States Patent [19]

Barrois et al.

[11] Patent Number: 5,562,036

[45] Date of Patent: Oct. 8, 1996

[54] DEVICE FOR SECURING PACKINGS IN PRINTING CYLINDERS

[75] Inventors: Claus D. Barrois, Erlenbach; Johannes G. Schaede, Würzburg, both of Germany

[73] Assignee: Koenig & Bauer Aktiengesellschaft, Wurzburg, Germany

[21] Appl. No.: 502,777

[22] Filed: Jul. 14, 1995

[30] Foreign Application Priority Data

Jul. 14, 1994 [DE] Germany ..... 44 24 930.6

[51] Int. Cl.[6] ..... B41F 27/06

[52] U.S. Cl. ..... 101/378; 101/415.1

[58] Field of Search ..... 101/378, 382.1, 101/415.1, 383

[56] References Cited

U.S. PATENT DOCUMENTS

| | | | |
|---|---|---|---|
| 2,898,854 | 8/1959 | Crawford | 101/415.1 |
| 3,702,098 | 11/1972 | Eburn | 101/415.1 |
| 3,795,193 | 3/1974 | Johne et al. | 101/415.1 |
| 3,896,727 | 7/1975 | Ruckdeschel | 101/383 |
| 3,896,729 | 7/1975 | Moyer | 101/383 |
| 3,926,118 | 12/1975 | Preuss | 101/415.1 |
| 4,813,356 | 3/1989 | Abendroth et al. | 101/378 |
| 5,097,763 | 3/1992 | Simeth | 101/382.1 |
| 5,398,609 | 3/1995 | Stiel | 101/415.1 |

FOREIGN PATENT DOCUMENTS

| | | | |
|---|---|---|---|
| 0715313 | 8/1965 | Canada | 101/378 |
| 3813777 | 12/1992 | Germany . | |
| 3-286866 | 12/1991 | Japan . | |
| 3-286867 | 12/1991 | Japan . | |

*Primary Examiner*—Edgar S. Burr
*Assistant Examiner*—Anthony H. Nguyen
*Attorney, Agent, or Firm*—Jones, Tullar & Cooper, P.C.

[57] ABSTRACT

A device for fastening a printing packing to a jacket surface of a printing cylinder uses a clamping carriage that is supported in a cylinder trough. The clamping carriage carries a clamping frame having a clamping face which cooperates with a clamping surface on a lateral trough wall. Clamping of the packing is accomplished without disturbing the position of a gripper device located in the cylinder trough. Transfer of the print material sheets free of register errors is made possible.

15 Claims, 3 Drawing Sheets

DEVICE FOR SECURING PACKINGS IN PRINTING CYLINDERS

FIELD OF THE INVENTION

The present invention is directed generally to a device for securing a packing on a printing cylinder. More particularly, the present invention is directed to a device for securing a packing on a printing cylinder which is equipped with a sheet gripper device. Most specifically, the present invention is directed to a device for securing a packing on a printing cylinder that is equipped with sheet gripper devices, including gripper supports and sheet grippers, disposed on its circumference. An axially extending cylinder trough is provided in the printing cylinder and this trough receives both the sheet gripper assembly, as well as a cylinder packing end clamping device. An end of the packing is insertable into this cylinder trough and extends in a direction parallel to the axis of the cylinder. This packing end is clamped between a lateral side wall of the trough and a cooperating clamping face of a clamping frame portion of the clamping device.

DESCRIPTION OF THE PRIOR ART

It is generally well known to utilize cylinder packings which are applied to the surface of various cylinders in a rotary printing press. These cylinder packings may underlie printing plates, rubber blankets or may be made integral with rubber blankets. The purpose of such a cylinder packing is to adjust the circumferential size of the cylinder to which the packing is attached. It is frequently necessary to attach a cylinder packing to a cylinder that includes sheet grippers which utilize gripper shafts, gripper fingers and gripper supports. The attachment of the cylinder packing to the cylinder and its tensioning on the cylinder in a manner which does not interfere with the operation of the sheet gripper devices is frequently a difficult task.

One prior art device which is usable to fasten and to tension a flexible foil or packing at the area where printing starts on a cylinder which is equipped with gripper devices, in a rotary printing press, is shown in German Patent Publication DE 38 13 777 C2. In this prior art device, the end of the foil or packing is held between holding rails by means of screws. These holding rails may be moved in the radial direction of the cylinder by rotation of a plurality of individually operable tensioning cams. Additionally, a plurality of elongated openings which pass through the packing are provided between the periphery of the printing cylinder and the holding rails. These are utilized for fastening the gripper impact strips to the lateral side walls of the cylinder trough.

A limitation of this prior art device is that the gripper position on the circumference of the printing cylinder is determined by the thickness of the packing which has been attached to the cylinder. A further limitation of this prior art device is that in the course of pivoting the tensioning flap in order to accomplish the changing of the packing, it is simultaneously necessary to structure the cam guidance of the grippers to be disconnectable. Additionally, the packing is tensioned in a non-uniform manner because of the plurality of holes which must be cut in it in the vicinity of the portion of the packing which is received and held in the cylinder trough. This non-uniform tensioning of the cylinder packing can lead to register irregularities during printing. The occurrence of such register irregularities is particularly problematic when the cylinder packing is somewhat elastic in nature, as would be the situation if the cylinder packing is a rubber blanket. It is also a limitation of this prior art device that a plurality of screws must be turned individually to operate the tensioning cams in the tensioning of the cylinder packing. This again is apt to result in non-uniform packing tensioning and its resultant register errors.

It will be apparent that a need exists for a device for securing packings on printing cylinders that overcomes the limitations of the prior art devices. The cylinder packing securing device in accordance with the present invention provides such a device and is a significant improvement over the prior art.

SUMMARY OF THE INVENTION

It is an object of the present invention to provide a device for securing packings on printing cylinders.

Another object of the present invention is to provide a device for securing a packing on a cylinder that has sheet gripper devices.

A further object of the present invention is to provide a device for securing a packing on the surface of a printing cylinder that is equipped with sheet grippers which include gripper supports and gripper abutment surfaces.

Still another object of the present invention is to provide a device for securing a packing end in a trough of a printing cylinder while permitting the positioning of a gripper device independently of the thickness of the packing.

Yet a further object of the present invention is to provide a device for securing a packing in a printing cylinder which allows the clamping of the packing by operation of a single screw.

As will be discussed in greater detail in the description of the preferred embodiment which is presented subsequently, the device for securing a packing in a printing cylinder in accordance with the present invention utilizes a packing clamping carriage which is slidably supported in an axially extending trough formed in the peripheral surface of a cylinder. The clamping carriage has an axially extending carriage clamping face that is cooperable with a trough clamping face formed in a lateral wall of the frame receiving trough. The packing clamping carriage is shiftable generally circumferentially in the trough by the axial movement of a control strip that is provided with a plurality of cam surfaced control blocks. The clamping carriage has a plurality of fingers that extend toward the control strip with these fingers carrying control rollers. The sheet gripper device is also positioned in the cylinder trough but is independent of the clamping carriage. The gripper device includes gripper abutment surfaces, gripper fingers and a gripper spindle or shaft. The gripper device is held in place by bearing blocks that also function to hold the clamping carriage in the trough while permitting it to slide circumferentially.

One significant advantage of the packing securement device in accordance with the present invention is the ability to precisely position the gripper system at the circumference of the printing cylinder independently of the thickness of the particular packing being used. This insures that the material, such as the sheets being printed, will always be accurate and correct in their positioning so that there will be no register errors. An additional advantage of the present invention is that no technical or sophisticated arrangement for disconnecting the cam guidance assembly for the sheet grippers is needed when the packing on the printing cylinder is being changed. The packing clamping carriage is shiftable in the cylinder trough independently of the positioning of the gripper assembly.

The end of the cylinder packing is inserted into the cylinder groove and is engaged by a clamping block clamping face portion of the clamping carriage and is held with an even, uniform holding force due to the continuous nature of the clamping face. This eliminates register irregularities. The packing also is not required to be provided with a plurality of elongated apertures, as was required by the prior art device. This also substantially reduces register errors.

The packing on the printing cylinder can be quickly and easily removed and replaced by actuating the single screw of the holding assembly. The rotation of this single screw shifts the control strip axially and thus allows the plurality of fingers on the clamping frame or carriage to move circumferentially thereby allowing the clamping block clamping face to move away from the cylinder packing.

The cylinder packing securing device in accordance with the present invention is also superior to the prior art devices because it allows a substantial tensile force to be applied to the cylinder packing. The cylinder packing is essentially continuous across its width and is held along its entire length in the cylinder trough by the clamping frame. The clamping face of the clamping frame, and the cooperating clamping face in the lateral cylinder trough wall can have complimentary profiled faces. This insures that the cylinder packing will be clamped and secured in a uniform, dependable manner.

The gripper device is held in place in the cylinder trough by spaced bearing blocks that support the gripper shaft or spindle. These bearing blocks also hold the packing clamping device in the cylinder trough while allowing the clamping carriage to move circumferentially in the trough to accomplish clamping and release of the cylinder packing.

It will thus be seen that the device for securing a packing on a printing cylinder in accordance with the present invention overcomes the limitations of the prior art. It is a substantial advance in the art.

BRIEF DESCRIPTION OF THE DRAWINGS

While the novel features of the device for securing a packing on a printing cylinder in accordance with the present invention are set forth with particularity in the appended claims, a full and complete understanding of the invention may be had by referring to the detailed description of the preferred embodiment which is presented subsequently, and as illustrated in the accompanying drawings, in which:

DETAILED DESCRIPTION OF THE PREFERRED EMBODIMENT

Figure 1:
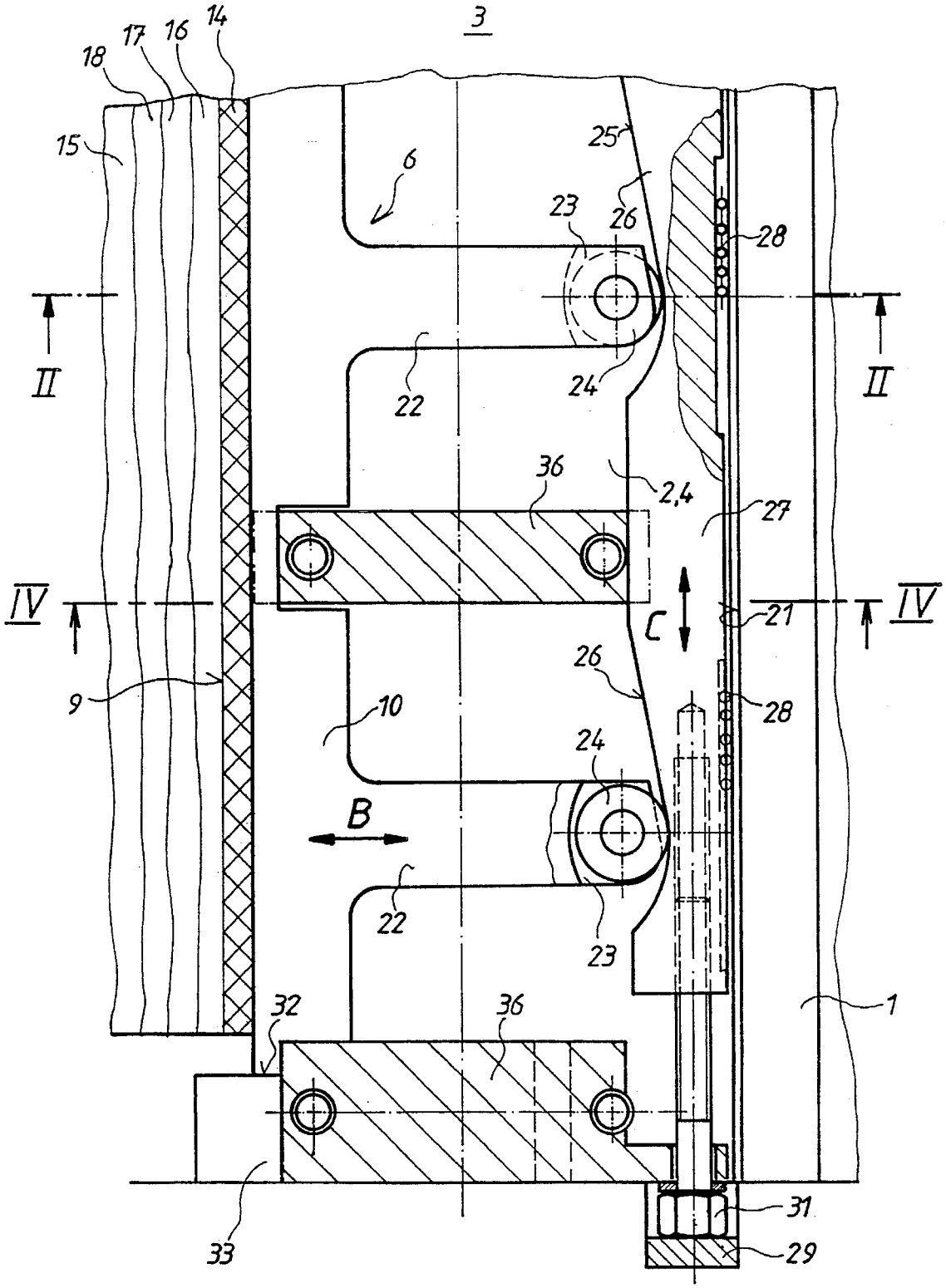
FIG. 1 is a top plan view, partly in section of a portion of a printing cylinder but with the gripper assembly removed for clarity, and showing the device for securing a packing on the printing cylinder in accordance with the present invention.
Figure 2:
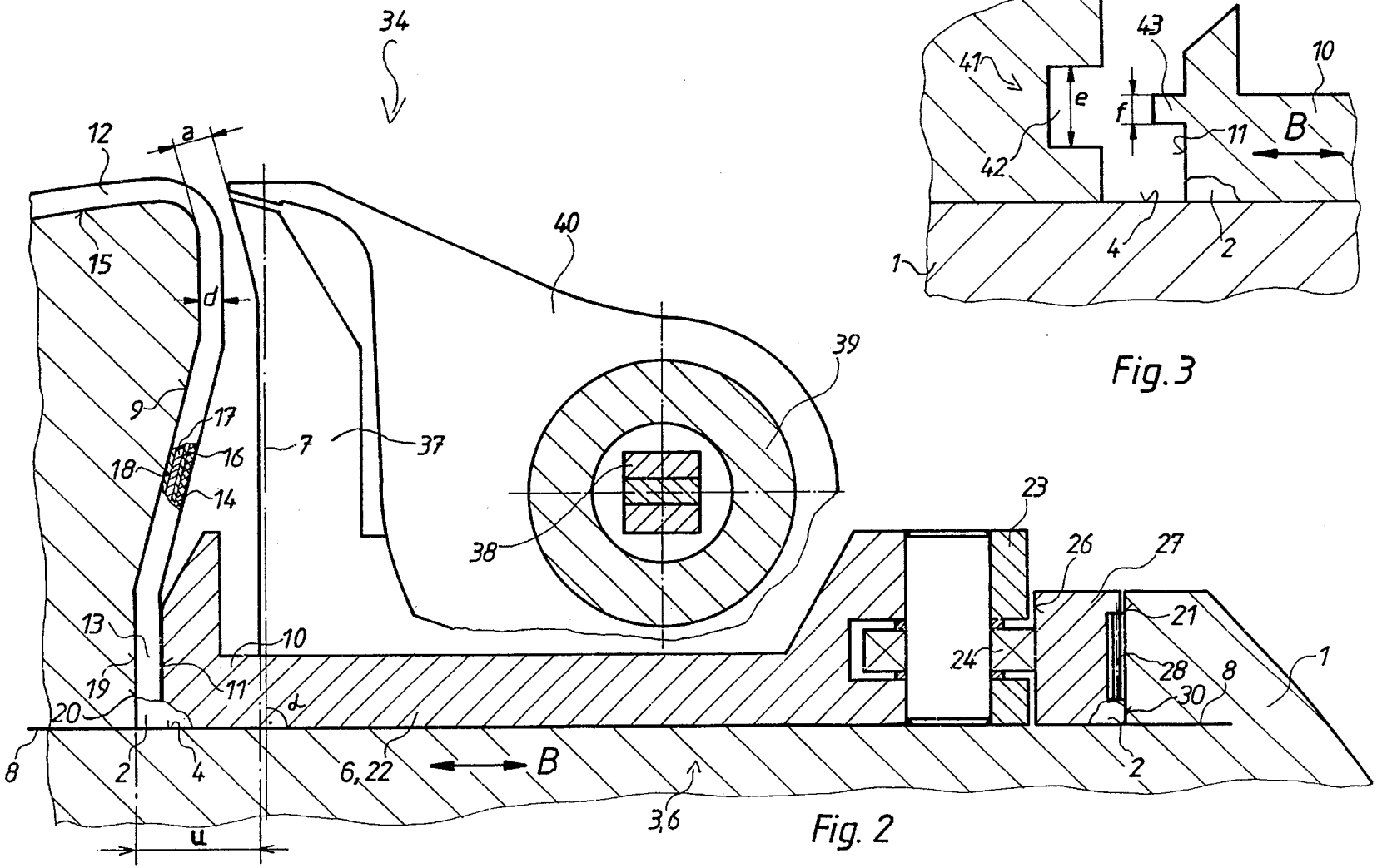
FIG. 2 is a cross-sectional view of the printing cylinder taken along line II—II of FIG. 1 and showing the packing securement device of the present assembly and the gripper system but without the gripper securement arrangement.

Referring initially to FIGS. 1 and 2, there may be seen at 1 a generally conventional printing cylinder which is usable in a rotary printing press to print a plurality of sheets. This printing cylinder 1 has a cylinder trough 2, as may be seen most clearly in FIG. 2, which extends across the peripheral surface of the cylinder 1 generally parallel to the axis of rotation of cylinder 1. This cylinder trough 2 has a flat trough bottom 4 and generally radially extending left and right lateral trough walls 9 and 21 respectively. The trough bottom 4 lies on a secant 8 of the printing cylinder 1.

A print packing holding or clamping device, generally at 3 is positioned in the cylinder trough 2. This packing holding or clamping device 3 is usable to clamp and hold a first end 13 of a print packing 12 on the cylinder jacket 15 of the printing cylinder 1. The print packing 12 is generally conventional and may include an outer rubber blanket 14 as well as one or more paper backing layers, such as paper backings 16, 17 and 18.

The packing clamping device 3 includes a packing clamping carriage 6 that is supported on, and which is movable across the bottom 4 of the cylinder trough 2 generally in the circumferential direction of the print cylinder, which is generally in the direction indicated by the double-headed arrow B in FIG. 2. Thus the clamping carriage 6 is movable toward and away from the two laterally spaced trough side walls 9 and 21. Clamping carriage 6 has an elongated, generally strip-shaped clamping frame 10 disposed on the carriage 6 adjacent the left lateral trough wall 19. This clamping frame 10 is provided with a strip-shaped packing clamping face 11 with this packing clamping face 11 being generally perpendicular to the trough bottom 4 and generally parallel to the left lateral trough wall 9 of the cylinder trough 2. The lower portion of the left lateral trough wall 19 has a trough packing clamping face 20 that cooperates with the frame packing clamping face 11 to clamp the end 13 of the blanket packing 12 therebetween.

Referring again to FIGS. 1 and 2, the strip shaped clamping frame 10 of the clamping carriage transitions into a plurality of spaced clamping frame fingers 22. These fingers extend away from clamping frame 10, in a comb-like manner, toward the right lateral trough wall 21. Two of these spaced fingers 22 are most easily seen in FIG. 1. Each of these clamping frame fingers 22 supports a control roller 24 at a finger end 23 generally remote from the clamping frame 10 and generally adjacent the right lateral trough wall 21. As may be seen most clearly in FIG. 2, each control roller 24 is supported for rotation about an axis that is generally perpendicular to the trough bottom 4. Each of these control rollers 24 is in frictional contact with a wedge or cam-shaped control block 26 with several of these control blocks 26 being carried on a first face of an axially extending control strip 27. As is shown in FIG. 1, the control strip 27 extends along the cylinder trough 2, generally parallel to the axis of rotation of the cylinder 1 and generally adjacent the right lateral trough wall 21. The control strip 27 is slidably supported against the right lateral trough wall 21 on a plurality of bearings, such as flat needle cages 28. These needle cages 28 engage a bearing surface 30 of the control strip 27.

The control strip 27 is shiftable in the axial direction of the printing cylinder 1, as indicated by arrow C, by operation of an adjusting screw 31 which, as may be seen in FIG. 1, extends axially into a threaded bore in the control strip 27. The head 31 of the adjusting screw is held against axial movement in a guide 29 that is attached to an end face of the printing cylinder 1. As the control strip 27 is shifted axially, the control blocks 26 will engage the control rollers 24 and will thereby cause the carriage 6 to move in the direction indicated by arrow B in FIG. 1 toward and away from the two lateral walls 19 and 21 of the cylinder trough 2. As may be seen in FIG. 1, the clamping frame 10 is constrained to move only in the direction indicated by the double-headed arrow B in FIG. 1; i.e. in the circumferential direction of cylinder 1, but not in the axial direction of cylinder 1, by the engagement of end faces 32 on the clamping frame 10 with end walls 33 on the printing cylinder 1. The second end, not shown of the print packing 12 will be tensioned by use of a generally well known clamping and tensioning device, which is also not shown, but which will be understood as being carried by the printing cylinder 1.

Turning now primarily to FIG. 2, the print cylinder 1 is provided with a gripping device, indicated generally at 34, which is usable to grip an end of a sheet and to hold the sheet on the print packing 12 on the cylinder 1. The gripper device 34 is secured in the cylinder trough 2 and is held in place by spaced bearing blocks 36, as may be seen in FIGS. 1 and 4. The gripper device 34 includes a gripper support 37, which can be modified to be adjustable in height, and a plurality of grippers 40 that are secured to a rotatable gripper shaft or spindle 39. These grippers 40 are biased into contact with the gripper supports 37 or the gripper abutment surfaces by suitable torsion springs 38 carried on the gripper shaft or spindle 39. As is generally known in the art, one end of the gripper spindle 39 will carry a cam follower which rides on a control cam so that the grippers 40 will move out of gripping engagement with the gripper supports 37 or the gripper abutments at the appropriate times during the rotation of the cylinder 1. The gripper spindle 39 is rotatably received in the several spaced bearing blocks 36, only one of which is shown in FIGS. 2 and 4.

Figure 4:
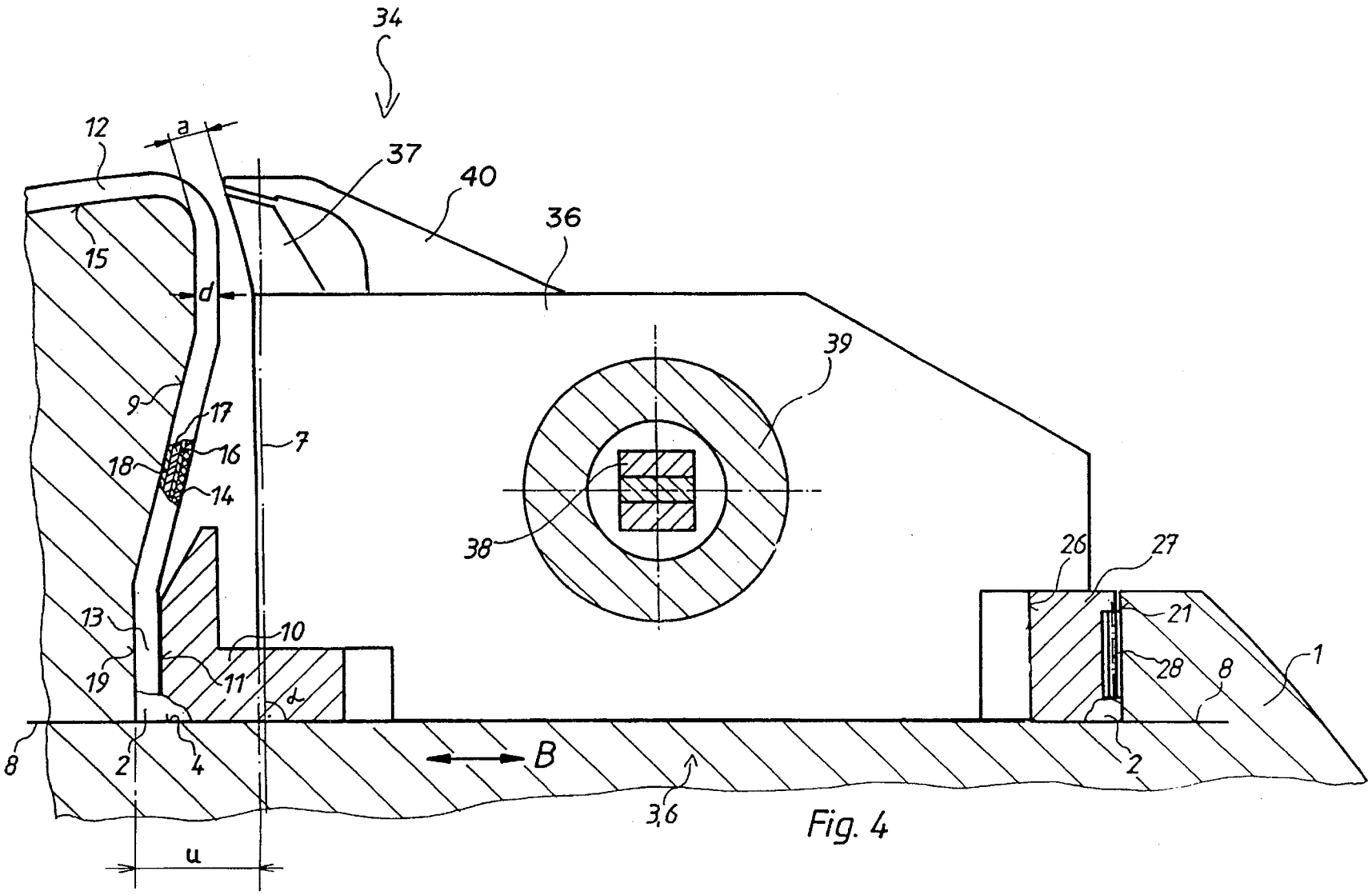
FIG. 4 is a view generally similar to FIG. 2 but taken along line IV—IV of FIG. 1 and showing the packing securement device in accordance with the present invention, together with the gripper device including the gripper bearing blocks.

As may be seen most clearly in FIG. 4, the bearing blocks 36 serve an additional function. In addition to supporting the gripper spindle or shaft 39, the bearing blocks 36 also position the clamping carriage 6 in place on the trough bottom surface 4. The bearing blocks 36 have cut-out portions on their bottom surface adjacent the trough side walls 9 and 21. These cut-outs are used as guides for the clamping frame fingers 22 and prevent the carriage 6 from falling out of the trough 2. As may be seen in FIGS. 1 and 4, the cut-out portions of the bearing block 36 overlie a portion of the clamping frame 10 and a portion of the control strip 27. These cut-outs allow the carriage 6 to move in the direction indicated by the double-headed arrow B but retain the carriage 6 in the trough 2.

Turning now again to FIGS. 2 and 4, the gripper support 37 is spaced from the left lateral trough wall 9 and serves as an insertion aid or guide for the end 13 of the print packing 12 into position where it will be engaged by the clamping surfaces 11 and 20. The gripper support 37 is spaced from the left lateral trough wall 8 at its radial outer end by a distance "a". This distance "a" is at least as great as the thickness "d" of the end 13 of the print packing 12 which is to be clamped on the jacket surface 15 of the print cylinder 1. This space can be created by providing the radially outer portion of the gripper support 37 with an appropriate contour. The distance between the gripper support 37 and the left lateral trough wall 9 opens radially inwardly to a maximum distance or width "u" adjacent the trough bottom 4 of up to six times the distance "a". This increased spacing between the radially inner portion of the gripper support 37 and the left lateral trough wall 9 provides adequate space for the positioning of the clamping block or frame 10 and for it to move, as is necessary during clamping and unclamping of the end 13 of the print packing 12.

Once the packing end 13 of the print packing 12 has been inserted into the cylinder trough 2 between the left trough wall 9 and the gripper support 37, and abuts the trough bottom 4, the clamping frame 10 can be moved to the left, as viewed in FIG. 2, to clamp the packing end 13 in place. Movement of the clamping frame 10 can be accomplished by axial sliding movement of the control strip 27, through rotation of the adjusting screw 31, as discussed previously. Alternatively, the carriage 6 could be moved along the trough bottom 4 with respect to the trough walls 9 and 21 by use of pneumatically operated work cylinders, electromotive means, or other known drive assemblies instead of the control strip 27.

The carriage clamping face 11 and the trough clamping face 20, which is located at the bottom portion 19 of the left trough wall 9, will be provided with cooperating surfaces. If desired, these two faces 11 and 20 can be smooth. Alternatively, these faces could be substantially roughened, such as by the application of cuts or scoring to them.

Figure 3:
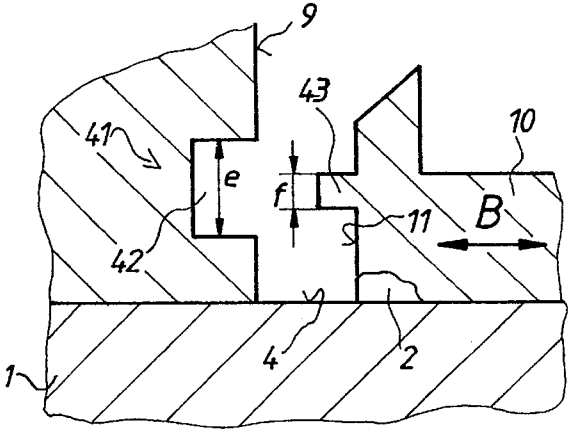
FIG. 3 is an enlarged detail view of a portion of the clamping assembly and showing profiled clamping faces.

In another alternative, as depicted in FIG. 3, the faces 11 and 20 could be provided with meshing coacting profiles. For example, the carriage clamping face 11 could be provided with an axially extending projection or tongue 43 having a height "f". The opposing wall clamping surface 20 of the lateral wall 9 could be provided with an axially extending, complimentary shaped groove 42 having a height "e". It will be appreciated that the groove height "e" must be equal to the protrusion height "f" plus twice the thickness "d" of the print packing 12 in order for the packing end 13 to be received and clamped between the carriage clamping face 11 and the left lateral wall clamping face 20.

It would also be possible, in accordance with the present invention, to provide, in place of the continuous protrusion 43 on the clamping face 11 of the clamping carriage 6, a plurality of spaced-apart bolts or pins which would each be received in an aligned blind bore in the portion 41 of the lateral wall clamping surface 20. The location of these projecting pins or bolts and receiving blind bores could be reversed, if desired. It will be understood that the packing end 13 of a print packing 12 used with such a modified clamping device would be provided with properly aligned precut holes or apertures to allow the bolts or pins to pass therethrough.

In operation, the clamping carriage 6 will be retracted toward the right lateral trough wall 21 by appropriate positioning of the control strip 27. The packing end 13 of the print packing 12 is inserted into the cylinder trough 2 between the trough wall 9 and the radial outer end of the gripper support 37. Once the packing end 13 engages the trough floor 4, the clamping carriage 6 can be shifted to the left, as seen in FIGS. 2 and 4, to bring the carriage clamping face 11 into clamping position adjacent the lateral wall clamping face 20. This will securely clamp the packing end 13 in place between the clamping faces 11 and 20. If the faces 11 and 20 are provided with their cooperating protrusion 43 and groove 42, as depicted in FIG. 3, the packing end 13 will become molded to these shapes and will be held even more securely in place. It will be understood that this protrusion 43 and its cooperating groove 42 can have any of a variety of complimentary shapes, such as rectangular, triangular, semicircular or any other arbitrary geometrical shape.

The sliding movement of the clamping carriage 6 with respect to the cylinder trough bottom 4 is accomplished without disturbing the position of the gripper device 34. This means that various print packings 12 can be secured to, and removed from the jacket surface 15 of the printing cylinder 1 without disrupting the positioning of the gripper support 37 and its cooperation with the grippers 40.

While a preferred embodiment of a device for fastening a packing on a printing cylinder in accordance with the present invention has been set forth fully and completely hereinabove, it will be apparent to one of skill in the art that a number of changes in, for example, the overall size of the printing cylinder, the type of printing being accomplished, the drive assembly for the cylinder and the like could be made without departing from the true spirit and scope of the present invention which is accordingly to be limited only by the following claims.

What is claimed is:

1. A device for fastening a packing on a printing cylinder of a rotary printing press comprising:

a cylinder trough extending in a peripheral surface of said printing cylinder and parallel to an axis of rotation of said printing cylinder, said cylinder trough having a trough bottom and spaced first and second trough walls;

a sheet gripper device positioned in said cylinder trough and including a gripper support and sheet grippers, said gripper support having an upper surface spaced at a fixed first distance from an upper portion of said first trough wall, said fixed first distance being at least as great as a maximum thickness of a packing to be fastened to the printing cylinder, said gripper support having a lower surface spaced from a lower portion of said first trough wall at a fixed second distance which is a multiple of said fixed first distance;

a trough clamping face formed on said lower portion of said first trough wall adjacent said lower surface of said gripper support and extending along said first trough wall parallel to said axis of rotation; and a clamping frame movably disposed in said cylinder trough and having an elongated, strip shaped clamping face, said clamping frame clamping face being generally perpendicular to said trough bottom, said clamping frame being movable with respect to said trough clamping face to clamp a packing end of a cylinder packing positioned therebetween.

2. The device in accordance with claim 1 wherein said clamping frame is formed on a first end of a clamping carriage which is movably disposed in said cylinder trough.

3. The device in accordance with claim 2 further including clamping frame fingers extending from said clamping frame toward said second trough wall.

4. The device of claim 3 further including a control strip having wedge-shaped control blocks adjacent said second trough wall, and a control roller on each of said fingers, said control roller on each said finger engaging an associated one of said control blocks on said control strip.

5. The device of claim 4 further including means to shift said control strip along said second trough wall.

6. The device of claim 5 further including bearings interposed between said control strip and said second trough wall.

7. The device of claim 6 wherein said bearings are flat needle cages.

8. The device of claim 1 wherein said clamping frame clamping face has a protrusion and further wherein said trough clamping face has a cooperatively shaped groove, said protrusion being insertable in said groove.

9. The device of claim 8 wherein said protrusion and said cooperatively shaped groove extend continuously across said clamping frame clamping face and said trough clamping face.

10. The device of claim 8 wherein said protrusion and said groove have complimentary arbitrary geometrical shapes.

11. The device of claim 8 wherein said protrusion is a plurality of spaced pins and said groove is a plurality of complimentary blind bores.

12. A device for fastening a packing on a printing cylinder of a rotary printing press comprising:

a cylinder trough extending in a peripheral surface of said printing cylinder and parallel to an axis of rotation of said printing cylinder, said cylinder trough having a trough bottom and spaced first and second trough walls;

a sheet gripper device positioned in said cylinder trough and including a gripper support and sheet grippers, said gripper support having an upper surface spaced at a fixed first distance from an upper portion of said first trough wall, said fixed first distance being at least as great as a maximum thickness of a packing to be fastened to the printing cylinder, said gripper support having a lower surface spaced from a lower portion of said first trough wall at a fixed second distance which is a multiple of said fixed first distance;

a trough clamping face formed on said lower portion of said first trough wall adjacent said lower surface of said gripper support;

a clamping frame formed on a first end of a clamping carriage which is movably disposed in said cylinder trough, said clamping frame having a clamping face, said clamping frame clamping face being movable with respect to said trough clamping face to clamp a packing end of a cylinder packing positioned therebetween, said clamping frame further including clamping frame fingers extending from said clamping frame toward said second trough wall; and a control strip having wedge-shaped control blocks adjacent said second trough wall, and a control roller on each of said fingers, said control roller on each said finger engaging an associated one of said control blocks on said control strip.

13. The device of claim 12 further including means to shift said control strip along said second trough wall.

14. The device of claim 13 further including bearings interposed between said control strip and said second trough wall.

15. The device of claim 14 wherein said bearings are flat needle cages.

* * * * *